United States Patent [19]

Ichise et al.

[11] 3,969,902

[45] July 20, 1976

[54] CONTRUCTION METHOD FOR CONTINUOUS ROW OF PILES AND EARTH DRILL FOR USE THEREFOR

[75] Inventors: Yoshio Ichise; Akio Yamakado, both of Tokyo, Japan

[73] Assignee: Yoshino Ichise, Tokyo, Japan

[22] Filed: July 22, 1974

[21] Appl. No.: 490,246

[30] Foreign Application Priority Data

July 23, 1973 Japan ..... 48-83450
June 29, 1974 Japan ..... 49-76663[U]

[52] U.S. Cl. ..... 61/35; 61/50
[51] Int. Cl.[2] ..... E02D 29/00; E02D 5/20
[58] Field of Search ..... 61/35, 53.64, 50, 59, 61/63

[56] References Cited

UNITED STATES PATENTS

| | | | |
|---|---|---|---|
| 2,791,886 | 5/1947 | Veder | 61/31 |
| 3,195,311 | 7/1965 | Degen | 61/35 |
| 3,310,952 | 3/1967 | Veder | 61/35 |
| 3,391,544 | 7/1968 | Daczko | 61/53.64 |
| 3,410,095 | 11/1968 | Turzillo et al. | 61/35 |
| 3,429,126 | 2/1969 | Wey | 61/35 |
| 3,504,497 | 4/1970 | Turzillo | 61/35 |
| 3,800,544 | 4/1974 | Nakanishi | 61/35 |
| 3,839,871 | 10/1974 | Dyer et al. | 61/35 |

*Primary Examiner*—Paul R. Gilliam
*Assistant Examiner*—Alex Grosz
*Attorney, Agent, or Firm*—Meyer, Tilberry & Body

[57] ABSTRACT

A method of forming a row of concrete piles in ground is disclosed wherein it is possible to position piles sufficiently close that additional concrete shoring on either side or between piles is unnecessary. A hole for a pile is first bored, the ground forming the hole is hardened and thereafter filled with concrete. This process is repeated for subsequently drilled holes until the row is completed. A drill is also disclosed which includes jet means to force ground hardening liquid under high pressure into the ground surrounding the hole. The jet means may be rotatably and/or axially moveable within the hole.

12 Claims, 12 Drawing Figures

FIG. 1
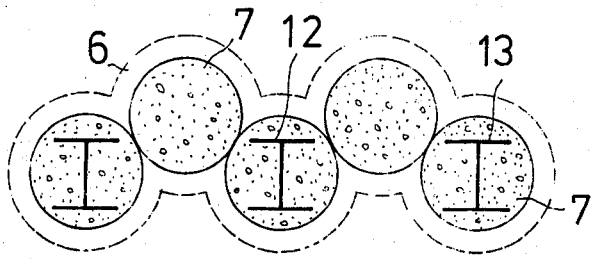
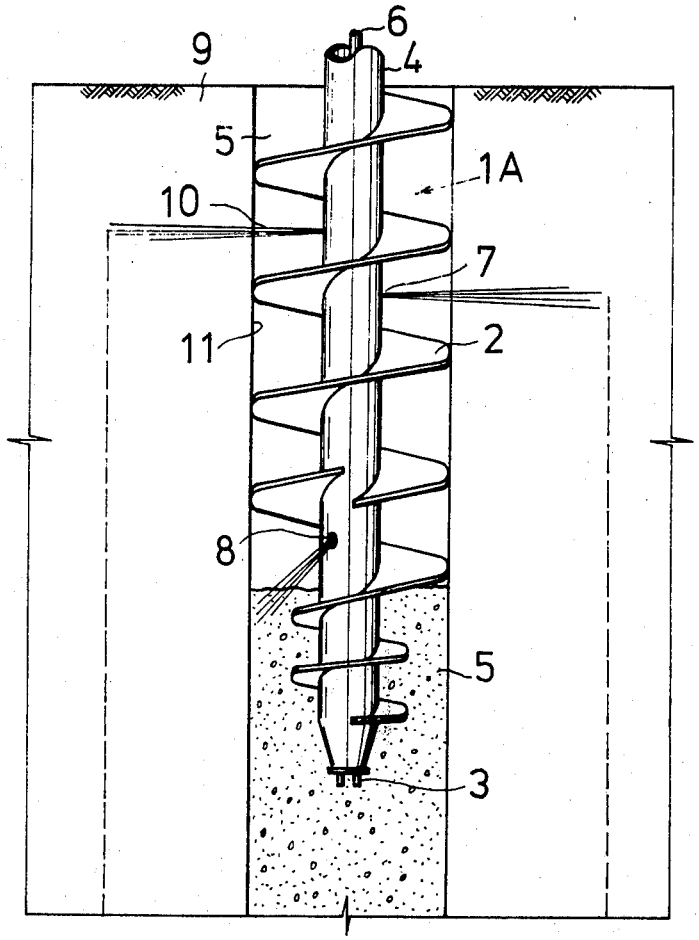
FIG. 2
FIG. 3
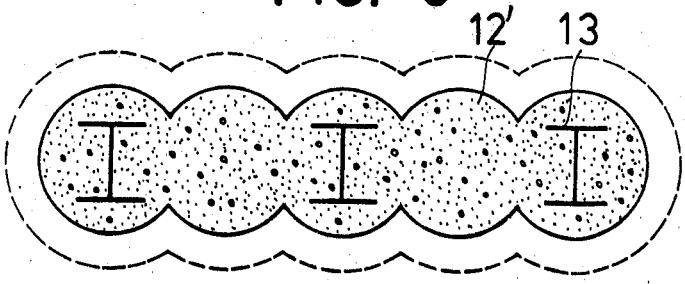

CONTRUCTION METHOD FOR CONTINUOUS ROW OF PILES AND EARTH DRILL FOR USE THEREFOR

BACKGROUND OF THE DISCLOSURE

This invention relates to a construction method for a continuous row of piles and an earth drill for use therefor, in which after a plurality of juxtaposed, vertical bores have been excavated in ground by means of an earth drill, water or ground hardening liquid is injected through a nozzle provided in the earth drill, as the earth drill is being withdrawn, into the vertical bores thus prepared, thereby forming a continuous row of juxtaposed piles serving as a pile wall or sheathing board for underground water.

Hitherto, many attempts, such as for instance, an ICOS method have been proposed for injecting into ground the mortar or the like which will be hardened thereafter, thereby forming an underground continuous wall. Typical of those attempts is that an earth drill having a hollow shaft is used for excavating ground to a given depth, after which motar or the like is injected through the hollow portion of the drill shaft into bores excavated in the ground, as the drill is being withdrawn, thereby forming a continuous row of piles under the ground.

However, according to such a prior art, there tends to often occur discontinuous portions or non-overlapped portion among the piles thus prepared, necessitating to inject the grout among piles or to the back thereof, when excavating the portion of ground encircled with such rows of piles. In addition, injection of grout sometimes accompanies difficulties which would lead to accidents such as water gushing. The invention contemplates to permeate a groundhardening liquid into the portion of ground surrounding bores which have been excavated by means of an earth drill following the excavation of bores, based on the principle disclosed in the invention, entitled "High Pressure Jet-Grouting Method", U.S. Pat. No. 3,802,203 possessed by the applicant.

SUMMARY OF THE INVENTION

It is accordingly the first object of the present invention to provide a construction method for a continuous row of piles, wherein a ground-hardening liquid is permeated into the ground, when the drill is being withdrawn, i.e., the ground surrounding the bores formed by means of the aforesaid drill, thereby eliminating the discontinuity among the piles thus formed.

It is the second object of the present invention to provide a construction method for a continuous row of piles, wherein the ground hardening liquid is injected under a high pressure in the horizontal direction to the bores or in the perpendicular direction to the peripheral walls of bores to thereby insure the permeation of ground hardening liquid into the ground surrounding bores.

It is the third object of the present invention to provide an earth drill of a double walled, tubular construction which enables the aforesaid high pressure injection of ground-hardening liquid, in line with the charging of mortar and the like.

It is the fourth object of the present invention to provide an earth drill which has a horizontal-direction-high-pressure-jet nozzle extending along a projecting or excavating blade, with the tip of the nozzle being open in the vicinity of the tip of the blade, and which is adapted for use in the aforesaid methods according to the present invention.

It is the fifth object of the present invention to provide an earth drill which has an exchangeable jet nozzle, for allowing the selection of a nozzle having a diameter suited for the intended construction of piles.

It is the sixth object of the present invention to provide an earth drill which permits ready change in the direction of injection from the horizontal to a given direction by using a joint flange, and which permits ready coupling to a double walled supply pipe and the like.

These and other objects of the present invention will be apparent from a reading of the ensuing part of the specification in conjunction with the accompanying drawings which indicate several embodiments of the present invention.

According to the present invention, there is provided an earth drill having a horizontal-direction jet nozzle leading to the hollow portion defined in the shaft of the drill, whereby ground-hardening liquid or water is injected therethrough to cut the ground surrounding bores formed by the drill, for the dual purposes of permeating the ground-hardening liquid into the ground surrounding the bores or filling cut bores with mortar, thereby presenting continuity or overlapped portions for the juxtaposed piles thus prepared.

BRIEF DESCRIPTION OF THE DRAWINGS

FIG. 1 is a partial plan view of a continuous row of piles after the completion of construction, while the portion of ground, in which ground-hardening liquid is permeated, is shown in a broken line;

FIG. 2 is a vertical cross-sectional view of an excavating drill in use in the course of the permeation of ground-hardening liquid and the filling of mortar according to the construction method of the present invention, while the portion of the ground, in which ground-hardening liquid is permeated, is also shown in a broken line;

FIG. 3 is a partial plan view of a continuous row of piles after the completion of the construction of piles, according to another embodiment of the present invention, while the portion of ground surrounding bores is cut to a further extent and shown in a broken line;

DESCRIPTION OF THE PREFERRED EMBODIMENTS

Figure 4:
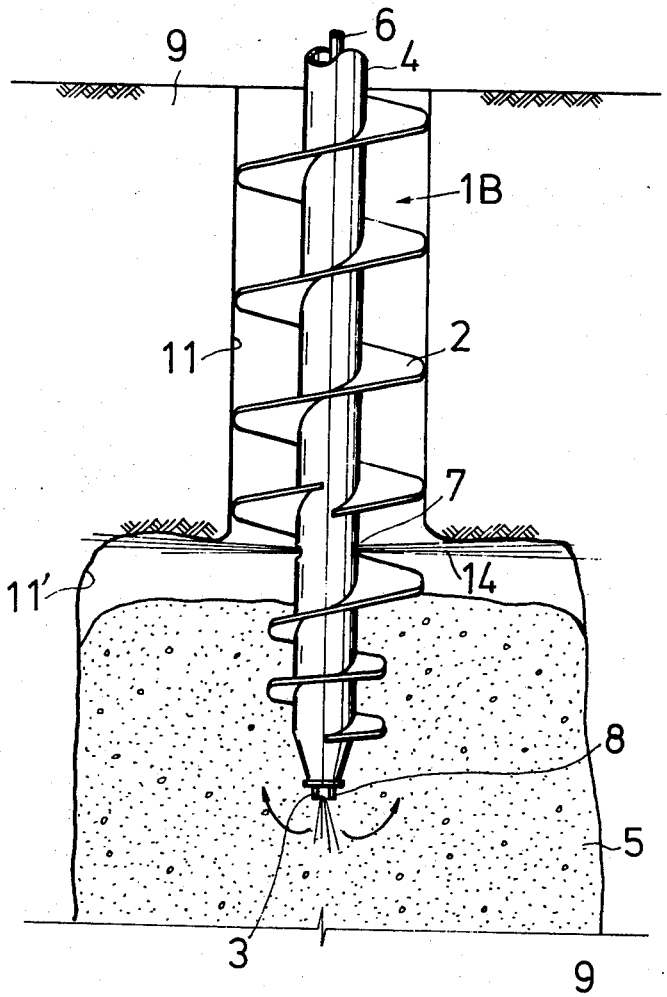
FIG. 4 is a vertical cross-sectional view of a drill in use in the course of the cutting of the peripheral wall of bores due to water injection, and the filling of mortar.

FIG. 2 shows an earth drill for use in the construction of a continuous row of piles. An earth drill 1A is formed with a helical excavating blade 2 provided on an outer tube 4 having a bit at its lower end, the aforesaid outer tube 4 having therein a passage (not shown) for mortar and the like such as concrete and defining an inner tube 6 therein, presenting double walled, tubular construction.

Provided in the outer tube 4 of the earth drill 1A are at least one horizontal jet nozzle 7 which is communicated with the inner tube 6. Also provided in the tip portion of outer tube 6 which is lower than the jet nozzle 7 is an injecting port 8 for injecting mortar therethrough.

Upon construction of a continuous row of piles, ground 9 is first excavated by means of earth drill 1A, and then the earth drill 1A is withdrawn under rotation. At this time, mortar is supplied through the passage defined between the outer tube 4 and the inner tube 6 from a supply pipe (not shown), while ground-hardening liquid 10 such as cement or water glass base grouts is supplied through the inner tube 6. Thus, the mortar 5 and ground hardening liquid 10 are separately fed through the earth drill 1A, whereby the mortar is filled through the injecting port 8 into a bore 11 and ground-hardening liquid 10 is injected under a high pressure against the peripheral wall of the bore 11 so as to permit the permeation of the liquid 10 in the ground surrounding bores for hardening same.

In this manner, the mortar 5 filled in the bore 11 will become a pile 12, while the ground surrounding bores will be hardened with ground hardening liquid 10, so that the piles thus prepared present overlapped construction, dispensing with the injection of grout. FIG. 1 shows a continuous row of piles thus prepared.

Alternatively, mortar may be filled in the bore from above, after the earth drill 1A has been withdrawn and, if necessary, I-steel 13 and other reinforcing materials have been placed in bores.

In this instance, the ground-hardening liquid 10 is injected, as the earth drill is being withdrawn under rotation. However, the direction of the nozzle may be set beforehand so as to direct toward the adjacent bore 11 or bore to be excavated next, and then the ground-hardening liquid 10 may be injected, without rotating the earth drill 1A. Still alternatively, the injection of the ground-hardening liquid may be injected in the ground surrounding alternate bores, rather than all of the bores.

FIG. 4 shows another type of an earth drill for use in other embodiment of the construction of a continuous row of piles according to the present invention. Although the earth drill 1B is of the same construction as that of the earth drill 1A, the usage thereof is different in that water 14 is injected under a high pressure through the jet nozzle 7.

If necessary, for filling of mortar 5 in line with the injection of water 14, the injection port 8 may be open in the center of the bit 3.

In case the earth drill 1B is used according to the same procedure as used in the earth drill 1A, the mortar 5 is filled in the bore 11 as well as in the bore 11' which has been excavated due to the high pressure injection of water 14, followed by the subsequent hardening of pile 12'. In this respect, the respective piles 12', 12' have portions of the ground which have been hardened and surround bore 11', thereby presenting an overlapped construction of piles.

FIG. 3 shows a continuous row of piles thus prepared.

Figure 5:
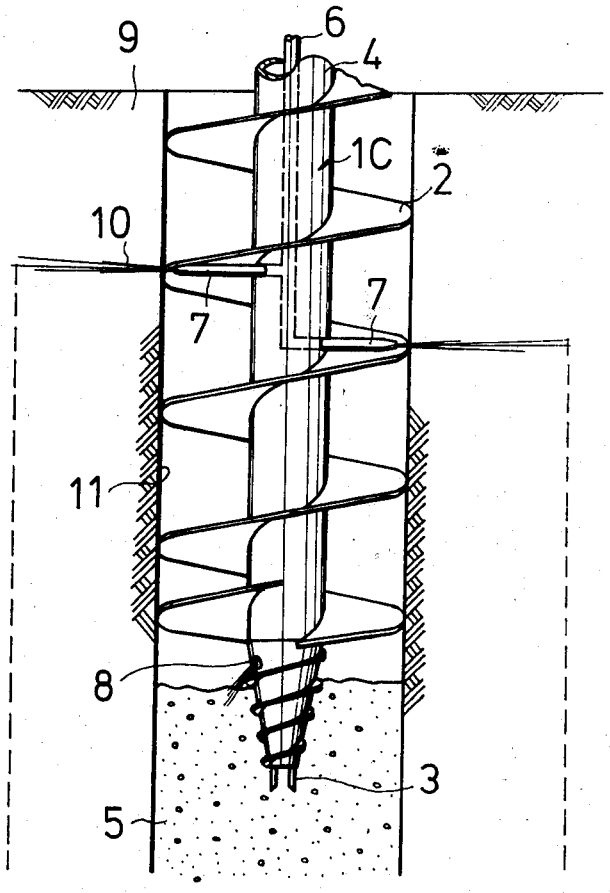
FIG. 5 is a vertical cross-sectional view of an earth drill according to another embodiment of the present invention, which is used in the course of the injection and permeation of ground-hardening liquid and the filling of mortar.

FIG. 5 shows a modification of an earth pile in use for the construction of a continuous row of piles. This earth drill 1C has a jet nozzle 7 extending along the undersurface or the top surface of the helical blade 2, with the tip of the nozzle 7 positioned close to the tip of the blade 2. The other parts of the construction of the jet nozzle 7 is the same as those of the earth drill 1A.

In operation, the earth drill 1C is used in the same manner as that of the earth drill 1A. However, because the tip of nozzle is positioned close to the tip of the helical blade 2 as well as close to the peripheral wall of the bore 11, the injection effect of the ground-hardening liquid 10 or water through the jet nozzle 7 will be further enhanced.

Now, description will be made of the construction of the earth drill attached to a supply pipe and the construction which permits the separate feeding of the two different kinds of liquids.

Figure 6:
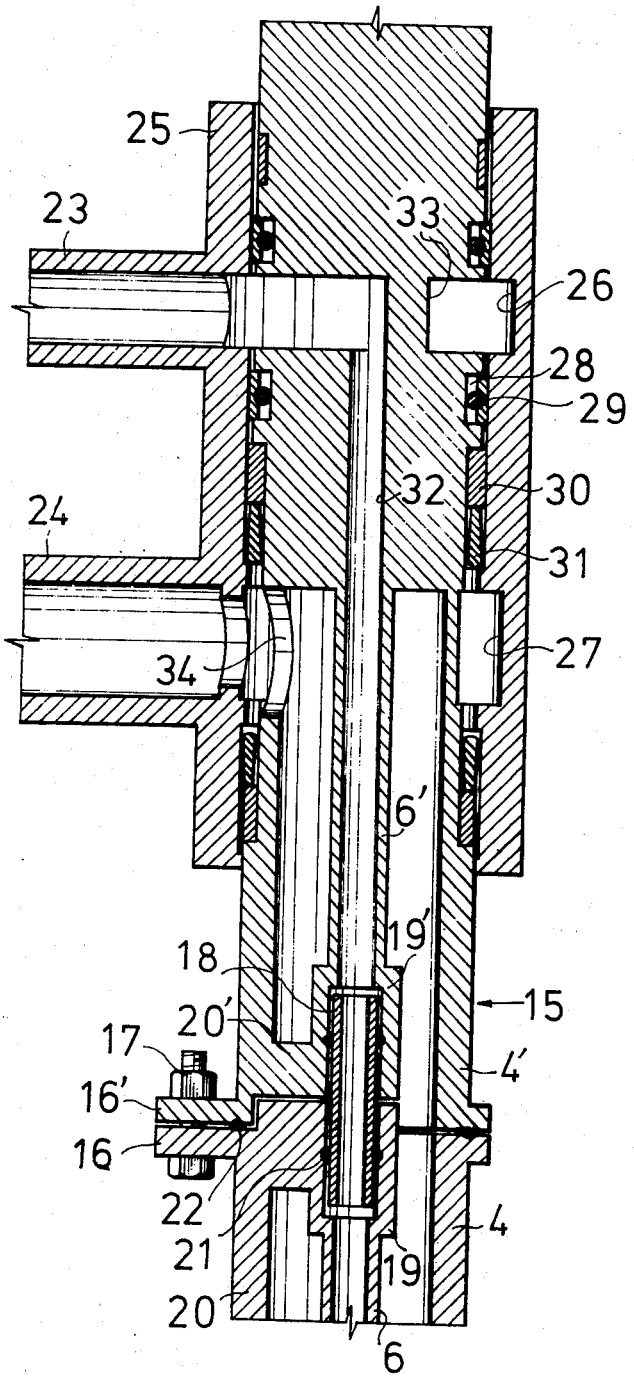
FIG. 6 is a longitudinal cross-sectional view of an arrangement of an earth drill attached to a supply pipe, showing two different kinds of liquids being supplied at the same time.

FIG. 6 shows a longitudinal cross-sectional view of the constructions above-referred. The feed pipe 15 has a double-walled, tubular construction, with its lower end coupled by means of a flange joint to the earth drill. More particularly, the joint flange 16' provided on the lower end of the outer tube 4' of supply pipe 15 is superposed on the joint flange 16 provided on the upper end of outer tube 4 of the earth drill, and those superposed flanges are secured together by means of bolts 17, while the inner tube 6' of the supply pipe 15 is registered with the inner tube 6 of the earth drill, with a tubular set pin 18 fitted in the both inner tubes.

In this respect, the inner diameters of the joint portions of the inner tubes 6 and 6' are enlarged so as to provided enlarged tubes 19, 19' for ready insertion of the set pin 18. The enlarged tubes 19, 19' are supported in the center of the outer tubes 6, 6', by means of supporting stays 20, 20', while O-rings are fitted on the set pin 18 but inwardly of the inner surfaces of the enlarged tubes 19, 19', thereby sealing the gaps therebetween. For providing further positive coupling of the earth drill to the supply pipe 15, the supporting stay 20 extends to a position upwardly of the joint flange 16, and the supporting stay 20' extends to a position lower than the joint flange 16', thereby providing a meshing relation thereto.

Shown at 22 is an O-ring fitted between the joint flanges 16, 16'.

Figure 7:
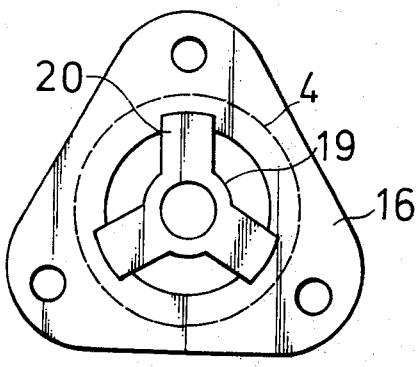
FIG. 7 is a plan view of the top of an earth drill.

FIG. 7 shows the construction of the earth drill having such a joint construction.

The supply pipe 15 is coupled at its upper end to a rotating mechanism (not shown) and is adapted to be rotated by means of the aforesaid rotating mechanism, with a tubular body 25 fitted thereon in sliding and rotating manner, the tubular body 25 having supply pipes 23, 24 projecting from the side wall of the body 25. Provided in the inner peripheral surface of the tubular body 25 are grooves 26 and 27 which include the openings of supply pipes 23, 24, respectively, while the gaps between the outer tube 4′ and the supply pipe 15 but above and below the aforesaid grooves 28 are sealed with O-ring 29 with a slipper seal, bushing 30 and packing 31. The outer tube 4′ has a solid construction in the range above the groove 27 of tubular body 25 and has in its center portion a hole 32 adapted to be registered with the top end of the inner tube 6′. On the other hand, provided in the outer surface of the outer tube 26 which faces the groove 26 in the tubular body 25 is a groove 33 communicating with the top end of the hole 32. Accordingly, ground-hardening liquid (not shown) or water (not shown) to be fed into the supply pipe 15 is first filled in the grooves 26 and 33 and then fed through the hole 32 and inner tubes 6, 6′ to the jet nozzle 7 for injection.

Provided in the portion of the outer tube which faces the groove 27 in the tubular body 25 is a communicating hole 34, through which the groove 27 is communicated with the hollow portion between the outer tube 4′ and the inner tube 6′. The mortar (not shown) which is to be supplied at a lower pressure through the supply pipe 24 is filled in the groove 27, then fed through the communicating hole 34, then through the outer tubes 4, 4′ downwards and out of the injection port 8.

According to the aforesaid supply pipe 15 and earth drill, the ground-hardening liquid 10 or water 14 and mortar 5 may be separately fed to the jet nozzle 7 and the injection port 8 at the same time.

Figure 8:
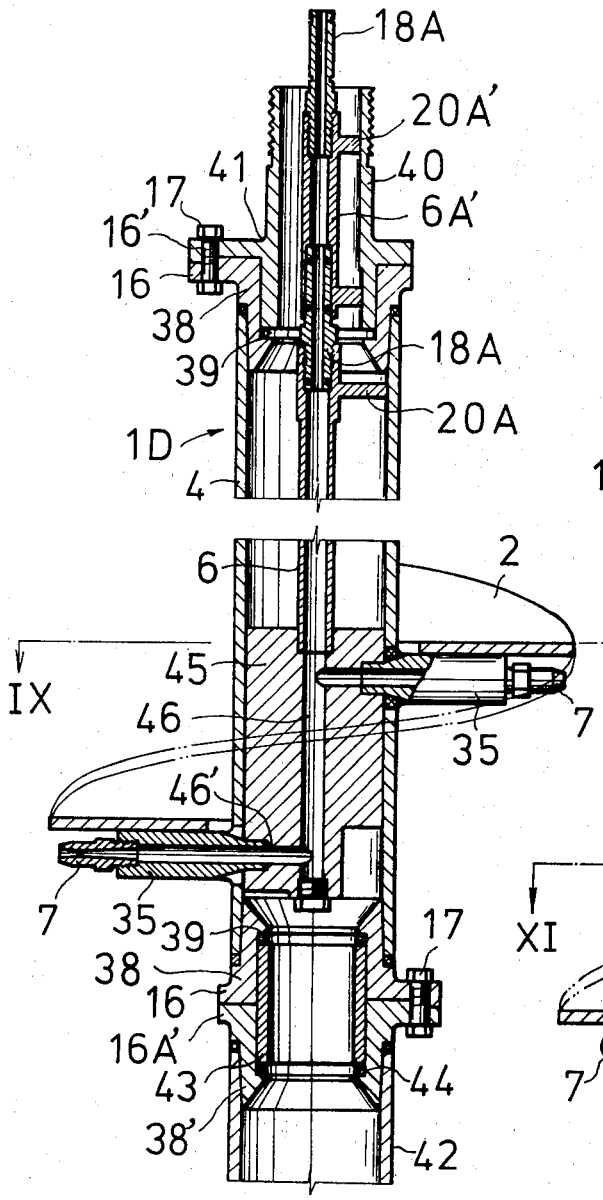
FIG. 8 is a longitudinal cross-sectional view of another type of an earth drill, its excavating blade being shown in a phantom line partially.
Figure 9:
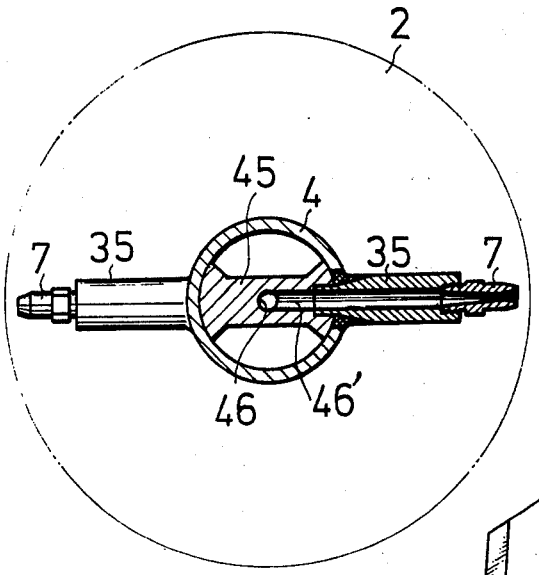
FIG. 9 is a transverse cross-sectional view of an earth drill, taken along the line A—A of FIG. 8, with the excavating blade being omitted, and the tip thereof being shown in a phantom line.

FIGS. 8 and 9 show another modification of the earth drill for use in the construction of a continuous row of piles. Unlike the previous earth drill 1C, the earth drill 1D has an attachment for the jet nozzle, which attachment is adapted to removably mount the jet nozzle 7 along the undersurface or top surface of the helical blade 2. In other words, there is provided a nozzle attaching tube 35 mounting the jet nozzle thereon and communicating with the inner tube 6 but extending in the radial direction of the outer tube 4. The jet nozzle 7 is threadingly attached to the tip of the respective nozzle attaching tubes 35, with the injection direction thereof being in coincidence with the axial direction of the tube 35, while the tip of the nozzle is positioned close to the tip of the helical blade 2.

The earth drill 1D is particularly adapted for use in case the drill is withdrawn from the bore 11 without rotation or with rotation through a limited given angle, with the injecting direction of the jet nozzle 7 directed to the adjacent bore or the portion of the ground to be excavated next. Setting of an injecting direction is made by utilizing the flange joint construction, of the line when the earth drill 1D is coupled to the supply pipe (not shown).

In this manner, the earth drill 1D is used particularly for the injection in a given direction.

Figure 10:
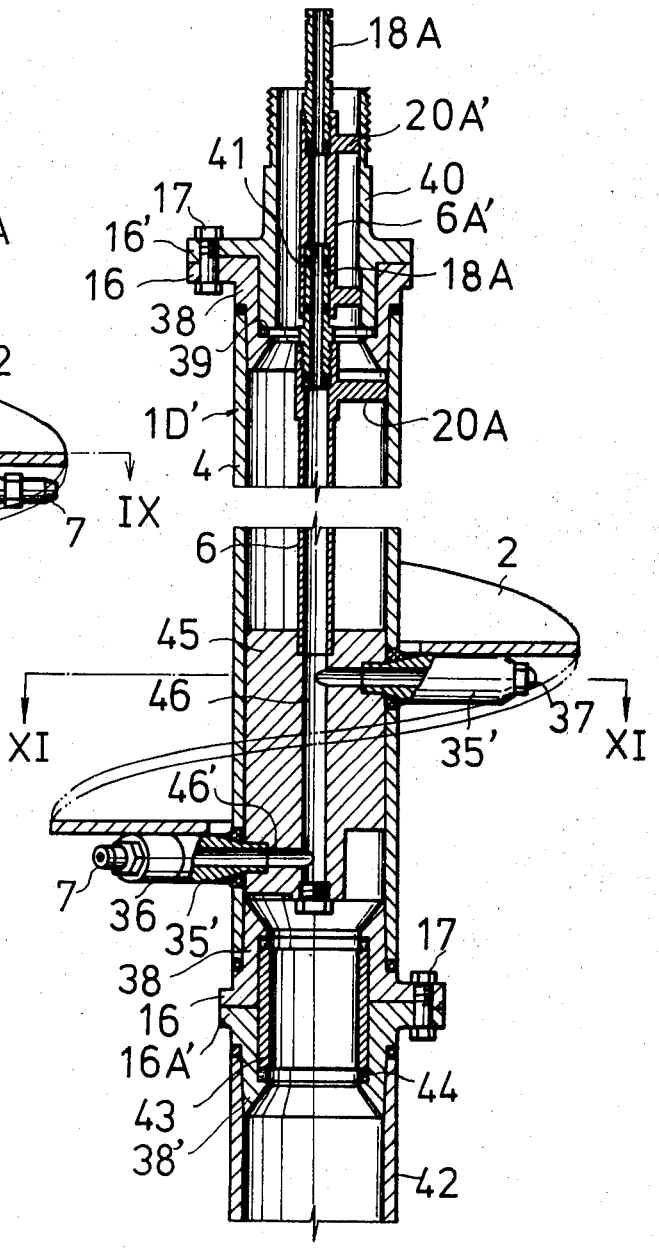
FIG. 10 is a longitudinal cross-sectional view of a further earth drill, the excavating blade thereof being partially shown in phantom line.
Figure 11:
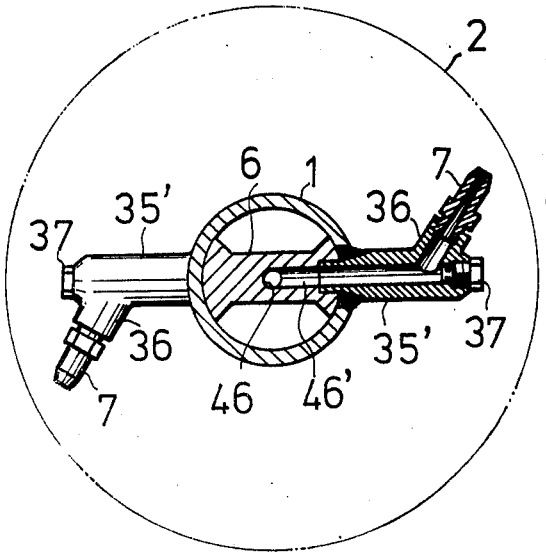
FIG. 11 is a transverse cross-sectional view of an earth drill, taken along the line B—B of FIG. 10, the excavating blade being omitted, and the tip thereof being shown in a phantom line; and, FIG. 12 is a perspective view of a still further earth drill, with the internal construction shown partially broken.

FIGS. 10 and 11 show a modification of a nozzle attaching tube used for an earth drill. This earth drill is adapted for use when withdrawing the same, with rotation and injection, from the bore (not shown), and has a nozzle attaching tube 35′ which has its tip closed and a branch tube 36 directed at an angle to the axial direction of the tube body which extends along the helical blade 2.

The jet nozzle 7 is threaded in the tip portion of the branch tube of nozzle attaching tube 35′. Shown at 37 is a plug threaded in the tip portion of the nozzle attaching tube 35′ for interrupting or controlling the direction of a high pressure jet stream through the nozzle.

In passing, if the closed tip portion and the branch tube 36 of the nozzle attaching tube 35′ are of such a construction as allows the threading attachment of the jet nozzle 7 and plug 37, the tube 35′ may be used either for injection with rotation or for injection in a given direction, by replacing same.

In addition, the jet nozzle having a suitably selected nozzle diameter is provided in the earth drills 1D and 1D′. Furthermore, the jet nozzle 7 is attached in a manner to be directed in the horizontal direction, when in use, and the tip of the nozzle is positioned close to the tip of the blade 2. Thus, this enhances the injection effect of the ground-hardening liquid or water under a high pressure, as compared with the previous earth drill 1C.

FIGS. 8 to 11 show another embodiment of the joint construction and the construction for feeding two different kinds of liquids separately. With the joint construction of the earth drill, a joint tube 38 having a joint flange 16 is fitted in and welded to the opposite ends of the outer tube 4, while the inner surfaces of the respective joint tubes are tapered in a divergent manner toward its tip and formed with engaging stepped portion 39 extending along the inner periphery of the inward edge of the joint tubes.

In case an earth drill is connected to the supply pipe (not shown) having substantially the same construction as that of the supply pipe 15, the top end of the joint tube 40 having a joint flange 16′ on the outer periphery but midway thereof is threaded into the lower end of the aforesaid supply pipe, while the aforesaid joint tube 40 is fitted in the upper joint tube 38 of the earth drill, and then the joint flanges 16 and 16′ are placed one on top of another for being secured by means of a bolt 17. In this respect, the inner tube 6′ supported by the supporting stay 20A′ inwardly but centrally of the joint tube 40 is fitted on the top end portion of the tubular set pin, whose lower end is threaded in the top end of the inner tube 6 of the earth drill, with the O-ring 41 interposed between the aforesaid top end of the set pin 18A and the inner tube 6A′. In this manner, the earth drill is coupled to the supply pipe by means of a joint tube 40, if necessary, with the aid of set pin 18A for coupling the inner tube 6A′ to the inner tube of the supply pipe.

On the other hand, in case a single walled auger 42 is coupled to the earth drill, a joint tube 38′ having the same construction as that of the lower joint tube 38 of the earth drill is fitted in and welded to the top end of the single walled auger 42, then a tubular packing 43 is placed in both of the joint tubes 38, 38′ to fill the gap between the joint flanges 16, 16A′, and then a O-ring 44 is interposed between the edge of the aforesaid packing and the engaging stepped portions 39 of the joint tube. Thereafter, the joint flanges 16, 16A′ are secured by means of the bolt 17 to press the upper and lower pairs of the O-rings 43 and 43.

In this manner, a single walled auger 42 may be coupled to the earth drill 1D or 1D′. Furthermore, in case a drill bit (not shown) is directly coupled to the lower end of the earth drill, another type of joint may be used in place of the aforesaid flange joint.

Now, description will be made of the construction of the earth drill which permits the simultaneous but separate feeding of the two different kinds of liquids. Provided in the longitudinally midway position of the outer tube 4 is a supporting plate 45 dividing the interior of the outer tube 4 lengthwise, while a communicating hole 46 extending through the supporting plate 45 in its center is in register at its top with the lower portion of the inner tube 6. In addition, the inner tube 6 is supported by means of the supporting stay 20, as has been described earlier. In this manner, the inner tube 6 is placed in the outer tube 4, being supported by the supporting stay 20 and supporting plate 45, while the inner tube 6 has its lower end closed with the plug threaded therein and is communicated with the nozzle attaching tube 35 by way of a branch hole 46' which is communicated with the aforesaid communicating hole 46.

Meanwhile, the flow path of the mortar is positively provided, irrespective of the joint tubes 38, 38', joint tube 40, supporting stay 20 and supporting plate 45.

Figure 12:
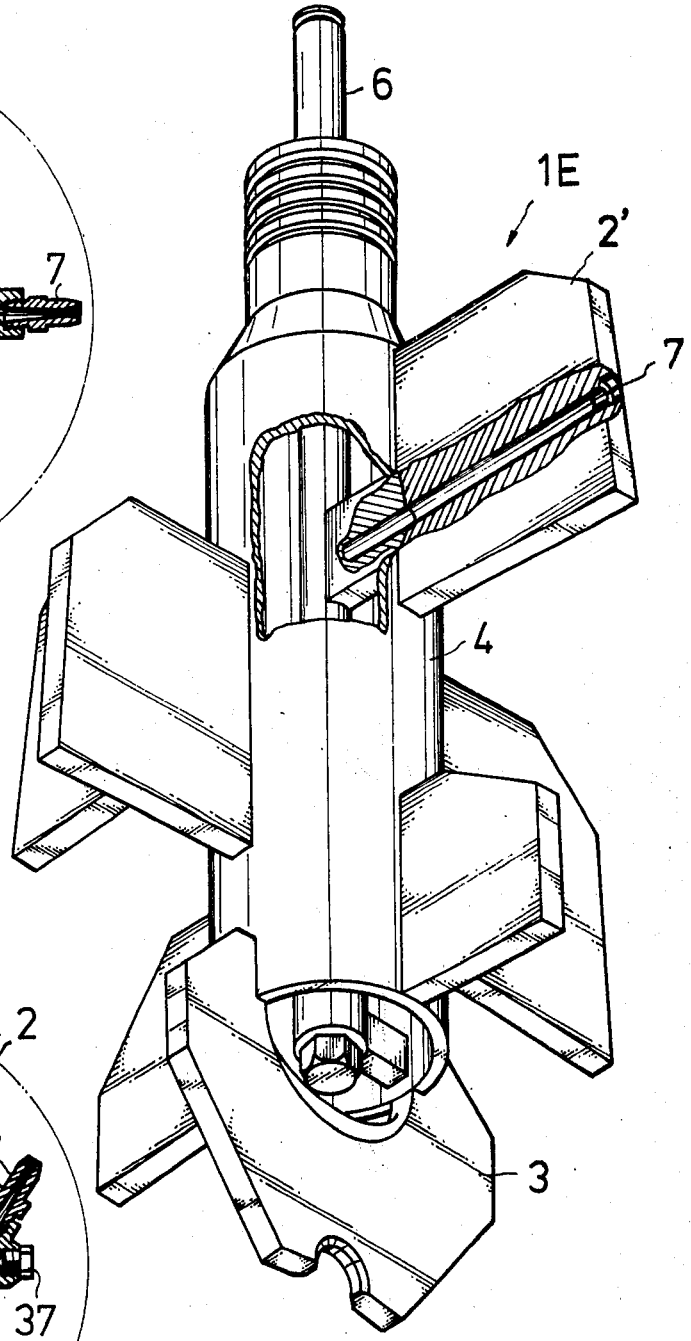

FIG. 12 shows one modification of an earth drill.

This earth drill 1E has a plurality of excavating blades formed on the outer periphery of the outer tube 4 in projection relation thereto, while a horizontal jet nozzle 7 is provided within a given excavating blade 2', with the nozzle tip being open close to the tip of the excavating blade. The earth drill 1E, as well, may present the same effect as that of the previous earth drills 1C, 1D, 1D' in the similar operation.

The effects of the earth drill according to the present invention may be summarized as follows:

1. Since the ground is excavated by means of an earth drill, the drill is then withdrawn, during which the ground-hardening liquid or water is injected under a high pressure against the wall of a bore at least adjacent thereto or the portion of the ground, in which a bore is to be drilled next, the portion of ground surrounding the bore is cut due to the high pressure injection stream and, in addition, the ground hardening liquid is permeated into the portion of the ground surrounding a bore, while the mortar may be charged in a bore thus cut along with the charging of mortar into the aforesaid bore thus excavated. This eliminates the possibility of the aforesaid continuous row of piles of causing discontinuity or non-overlapped portion among the piles, thus dispensing with the post processing such as injection of grout as experienced with the prior art. As a result, the construction of a continuous row of piles may be achieved in an improved efficient manner.
2. Since the earth drill has a double walled, tubular construction which permits simultaneous feeding of the two different kinds of liquids, mortar may be charged in a bore, as the earth drill is being withdrawn, with the improvement in the efficiency of the construction.
3. Since the jet nozzle is provided in a manner to extend along the helical blade of the earth drill, with the tip of the nozzle located close to the tip of the blade, the inner peripheral wall of a bore may be cut efficiently, and ground-hardening liquid may be injected positively. This enhances the positiveness of the construction of piles.
4. Since the jet nozzle in the earth drill is attached to the nozzle attaching tube in the direction at an angle to the axial direction of the tube body, the nozzle diameter and the type of injection of a nozzle may be suitably selected. This also enhances the positiveness of the construction of piles.
5. Since the top end of the outer tube in the earth drill is formed with a joint flange, the assembly of the earth drill is rendered ready and positive.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, all changes which come within the meaning and range of equivalency of the claims are therefore intended to be embraced therein.

What is claimed is:

1. A method for forming a continuous row of piles comprising the steps of:
- boring a first hole in the ground;
- hardening the ground surrounding said first hole by forcing a ground hardening liquid under high pressure into said ground surrounding said first hole;
- filling said first hole with mortar;
- boring a second hole adjacent said first hole;
- hardening the ground surrounding said second hole by forcing a ground hardening liquid under high pressure into said ground surrounding said second hole, a portion of the ground surrounding said first and second holes being common to both said holes;
- filling said second hole with mortar, and
- repeating said steps of forming said piles until a row of piles has been completed.

2. The method of claim 1, wherein the step of hardening the ground forming said holes is by forcing ground hardening liquid under high pressure into the ground surrounding each drilled hole in a direction toward the next hole to be drilled.

3. The method of claim 1, wherein the step of hardening the ground forming the holes is by forcing ground hardening liquid in a jet stream under high pressure into said ground.

4. The method of claim 1, wherein the step of hardening the ground forming the holes is by rotating a high pressure jet stream of ground hardening liquid in said holes.

5. The method of claim 1, wherein the step of hardening the ground forming the holes is by simultaneously rotating and axially moving a high pressure jet stream of ground hardening liquid in said holes.

6. The method of claim 1, including the steps of tangentially aligning said holes.

7. The method of claim 1, including the steps of overlapping the bores of said holes.

8. The method of claim 1, including the step of adding reinforcing metal to said piles.

9. The method of forming a row of piles comprising the steps of:
- boring in sequence a row of holes;
- hardening the ground adjacent each hole after it has been bored by forcing a ground-hardening liquid under high pressure into said ground adjacent said hole;
- positioning each subsequent hole sufficiently close to the preceeding hole so that a portion of the hardened ground adjacent each hole is common to both holes, and
- filling each hole with mortar after the ground surrounding each hole has been hardened.

10. The method of claim 9, including the step of tangentially aligning said holes.

11. The method of claim 9, including the step of overlapping said holes.

12. The method of claim 9, including the step of adding reinforcing metal to said piles.

* * * * *